US005259929A

United States Patent [19]

Bubik et al.

[11] Patent Number: 5,259,929

[45] Date of Patent: Nov. 9, 1993

[54] TWIN WIRE FORMER

[75] Inventors: Alfred Bubik, Ravensburg; Otto Hildebrand, Ravensburg-Taldorf; Karl Muller, Ringgenweiler; Jorg Walter, Wiesbaden-Taunusstein, all of Fed. Rep. of Germany

[73] Assignee: Sulzer Escher Wyss GmbH, Ravensburg, Fed. Rep. of Germany

[21] Appl. No.: 824,353

[22] Filed: Jan. 23, 1992

[30] Foreign Application Priority Data

Jan. 24, 1991 [DE] Fed. Rep. of Germany ..... 4102065

[51] Int. Cl.[5] ..... D21F 9/02; D21F 1/36

[52] U.S. Cl. ..... 162/301; 162/300; 162/352

[58] Field of Search ..... 162/300, 301, 348, 352

[56] References Cited

U.S. PATENT DOCUMENTS

| | | | |
|---|---|---|---|
| 3,876,499 | 4/1975 | Vesanto | 162/301 |
| 4,125,428 | 11/1978 | Phelps | 162/301 |
| 4,417,950 | 11/1983 | Bubik et al. | 162/300 |
| 4,769,111 | 9/1988 | Nevainen et al. | 162/301 |
| 4,790,909 | 12/1988 | Harwood | 162/301 |
| 4,925,531 | 5/1990 | Koski | 162/301 |
| 4,988,408 | 1/1991 | Evalahti | 162/301 |
| 5,074,964 | 12/1991 | Portonen | 162/301 |

FOREIGN PATENT DOCUMENTS

| | | | |
|---|---|---|---|
| 0160615 | 11/1985 | European Pat. Off. . | |
| 0289445 | 11/1988 | European Pat. Off. . | |
| 2000661 | 9/1970 | Fed. Rep. of Germany . | |
| 2102717 | 8/1971 | Fed. Rep. of Germany . | |
| 3138133 | 3/1983 | Fed. Rep. of Germany | 162/301 |
| 3815470 | 11/1989 | Fed. Rep. of Germany . | |
| 8911000 | 11/1989 | World Int. Prop. O. . | |

OTHER PUBLICATIONS

Baumann "New Top Wire Forming Unit . . . " Pulp & Paper Apr. 1989.

*Primary Examiner*—Karen M. Hastings
*Attorney, Agent, or Firm*—Sandler Greenblum & Bernstein

[57] ABSTRACT

A twin wire former wherein the forming turbulence of a first forming section is quieted by a main forming roller. Behind the main forming roller, as viewed with respect to a predetermined direction of travel of the forming wires, there is accomplished a further forming of the paper web or sheet from the fiber stock suspension in a second forming section. Due to this arrangement there is possible optimum formation of the paper web or sheet with the use of very little dilution water for the fiber stock suspension. Additionally, due to intensive shear forces present in the second forming section flocks formed in the fiber stock suspension and the paper web or sheet at the region of the main forming roller, can be eliminated so that the structure of the paper web or sheet is made more uniform.

27 Claims, 4 Drawing Sheets

TWIN WIRE FORMER

BACKGROUND OF THE INVENTION

1. Field of the Invention

The present invention relates to a new and improved twin wire former for the manufacture of paper or the like.

Generally speaking, the twin wire former of the present development for the manufacture of paper or the like is of the type comprising two co-running endless revolving forming wires which converge towards or merge with one another to conjointly form therebetween a fiber stock inlet gap or wedge opening. In this condition the forming wires are conjointly guided along a web or sheet forming zone. One of the forming wires defines a transport wire and the other forming wire defines a counter wire. Additionally, there is provided at least one forming roller about the circumference of which there are at least partially conjointly trained or wrapped both of the endless revolving forming wires. As viewed in a predetermined direction of travel of the forming wires at least one stationary forming element is arranged forwardly or upstream of the forming roller in a first forming section at one side of the two forming wires and bears against at least one of the forming wires.

2. Discussion of the Background and Material Information

Such type twin wire former has been disclosed in the German Published Patent Application No. 3,815,470, published Nov. 16, 1989. In such twin wire former there are incorporated forming shoes, forming rollers and support surfaces which are intended to guide a first forming wire or a second forming wire. The shear load between the forming wires exerted upon the fiber stock suspension is weak, and that is the reason that such twin wire former must be operated with an appreciable amount of dilution water. When fabricating packaging paper have a weight in the range of 100 g/m$^2$ to 280 g/m$^2$ this results in a large structural height of the former which can exceed 8 meters and requires a greater length for the formation of the sheet or web formed from the fiber stock. In this twin wire former during the formation of the web, the web forming process is completed at a point E (FIG. 2) of the wrap length of the forming roller. Thereafter, there is still carried out dewatering at a support surface and a suction roller.

On the other hand, when fabricating packaging paper there are increasingly attained, with so-called Intensa presses, greater operating velocities exceeding 1000 m/min. In this regard and as can be gleaned from the European Published Patent Application No. 0,289,445, published Nov. 2, 1988, considerable difficulties are encountered in the removal of water, especially in a direction opposite to the direction of the force of gravity. The forming wire water cannot be directly removed perpendicular to the forming wire at the site where it is formed. Rather, such forming wire water first must be collected at guide surfaces and suctionally removed by vacuum. As a result, contaminants are produced, particularly an undesired stock-mist formation.

In the solution proposed in U.S. Pat. No. 4,790,909, granted Dec. 13, 1988, there is strived to obtain symmetrical dewatering of the web or sheet. However, since the forming shoes are arranged in offset configuration, the dewatering towards the outside differs with time and is of different intensity, resulting in an irregular formation structure of both sides of the paper web or sheet. Additionally, the equipment has a very large structural height, leading to vibrations of parts of the equipment or machine, and thus, impairs the quality of the fabricated paper. In particular, at especially high machine velocities the turbulence of the stock suspension produced by the stationary dewatering elements is impermissibly increased and there is marred the web or sheet formation.

SUMMARY OF THE INVENTION

Therefore, with the foregoing in mind, it is a primary object of the present invention to provide an improved twin wire former for a papermaking machine which is not afflicted with the aforementioned shortcomings and drawbacks.

Another and more specific object of the present invention aims at providing an improved twin wire former of the previously mentioned type, wherein, with relatively small structural height of the equipment and the use of reduced amounts of dilution water there can be realized an optimum and substantially uniform formation structure of the fabricated paper.

Still a further noteworthy object of the present invention concerns the provision of an improved twin wire former of a papermaking machine which affords the possibility of operating the headbox with less water, resulting in a saving in space since equally lesser amounts of water have to be removed at the forming wires.

Now in order to implement these and still further objects of the present invention, which will become more readily apparent as the description proceeds, the twin wire former of the present development is manifested, among other things, by the features that a second forming section is arranged after the forming roller in the predetermined direction of travel of the forming wires, and a further stationary forming element is arranged at least at one side of the second forming section and bears against at least one of the forming wires.

By virtue of this solution it is possible to operate the papermaking machine with less dilution water, that is, the machine can be operated with relatively little water in the headbox. This, in turn, results in a saving in space, since less water must be drained through the forming wires. Furthermore, the angular arrangement of both of the forming sections likewise results in a reduced structural height of the papermaking machine, and this, in turn, results in lesser machine vibrations. An increase in the turbulence of the fiber stock suspension brought about by the employed forming foils or foil ledges of the first forming section is interrupted by the forming roller located between the aforementioned forming sections. There is realized a protective formation of the web or sheet with good web formation and high retention of fillers. By means of the second forming section, following the turbulence-quieting or turbulence interrupting forming roller, there are applied particularly intensive shearing forces to the fiber stock suspension and the web. Consequently, at the region of the forming roller, defining a main forming roller, there can be desirably eliminated at least partially formed flocculations and there can be rendered more regular or uniform the structure of the web.

By means of the inventive system or equipment there are thus prevented contaminations and a so-called stock-mist formation. Additionally, there is possible effective removal of water even counter to the force of gravity without the requirement that the wire water first be guided over guide surfaces.

As concerns a further improvement with respect to reduced structural height of the system in conjunction with optimum formation of the web or sheet, both of the forming sections are mutually dispositioned with respect to one another so as to enclose therebetween an angle between 30° and 120°, in particular an angle of essentially 90°. In this connection, one of the forming sections may be substantially horizontally arranged.

Advantageously, when there is used a vertically oriented headbox or even a headbox arranged at an inclination, the first forming section can be vertically oriented.

Due to the employment of the intermediately disposed forming roller or roll there is rendered superfluous the requirement of using a particular suction roller. Nonetheless, due to the provision of the second forming section there is obtained a greater dry content in contrast to the twin wire former construction disclosed in the aforementioned German Published Patent Application No. 3,815,470, published Nov. 16, 1989 with utilization of the suction roller. In addition, there is realized a better web or sheet formation. Still further, in particular with a slight deflection or turning of the forming wires over the forming roller in conjunction with or small structural height of the equipment, there is present a relatively modest shearing action, and specifically, in contrast to the relatively great shearing action which is exerted upon the formed web or sheet due to the 180° deflection occurring at the suction roller as disclosed in such German Published Patent Application No. 3,815,470.

The forming roller located between the stationary forming elements has a considerable influence upon the dewatering of the paper web. Additionally, the deflection or turning of the two forming wires taking place at the forming roller ensures that the former can be beneficially constructed to be exceedingly compact and at the same time there is enhanced the dewatering of the paper web due to propelling away of the water owing to the prevailing centrifugal force. When there is present a vertically disposed first forming section the stock infeed gap or wedge opening can be advantageously arranged above or below the first forming section.

The stationary forming elements can be constituted by a so-called forming shoe or at least one forming pressure foil or foil ledge or equivalent structure. Here, the possibility exists of arranging the resilient, adjustable forming pressure foils laterally, that is, to the right or left or at the top or bottom, respectively of the twin wire former.

A further forming roller can be provided at the region of the headbox, especially beneath the first vertically oriented forming section, and specifically, laterally either at the left or right side of the twin wire former arrangement. However, there also can be provided two further forming rollers.

The forming rollers at the region of the headbox have a quieting (turbulence-suppressing) effect upon the fiber stock suspension. This can be desired, although, however, it is not always desired. If no forming rollers are provided at this region, then the fiber stock suspension possessing turbulence as it effluxes from the headbox is guided into the turbulence-receiving or also turbulence-augmenting zone which is characterized by the stationary foils or foil ledges which contact the forming wire.

After the web or sheet has moved through the first forming section equipped with stationary forming elements, there follows, in the direction of travel of the forming wires and the paper web or sheet, the main forming roller. This main forming roller produces considerable quieting of the turbulent fiber stock suspension. There then follows a re-newed generation of turbulence in the fiber stock suspension by the second forming section equipped with at least one stationary forming element. In this second forming section there is especially prevented flocculation in the stock suspension layer. An important feature of the present invention is the presence of a turbulence-increasing forming section following the deflection or forming roller.

In the first, especially vertically oriented forming section containing the stationary forming elements there is accomplished an approximately 20% dewatering of the paper web. At the intermediately situated forming roller or roll itself there occurs an approximately 40% dewatering of the paper web. Finally, at the subsequent, especially horizontally arranged forming section provided with stationary forming elements there occurs, for example, an approximately 20% dewatering of the paper web. These percentage values relate to the volumetric values of the quantities of the fiber stock suspension originally present in the headbox.

An especially advantageous construction of the twin wire former of the present invention containing both of the forming sections and the intermediately disposed main forming roller embodies an essentially vertically orientation of the first forming section and an essentially horizontal orientation of the subsequently arranged second forming section.

The length of the second forming section advantageously amounts to at least 80% of the wrap length of the forming wires at the forming roller located between the first and second forming sections. However, this length of the second forming section also can be equal to or greater than the wrap length of the forming wires at the forming roller located between the first and second forming sections.

When using stationary forming pressure foils or foil ledges there can be arranged in succession or tandem at a forming location four to five such stationary forming pressure foils or foil ledges.

When there is provided in one of the forming sections only one forming shoe with suction dewatering, then such forming shoe should have a curved surface, so that at this region there is not necessary any further support of the twin forming wires. There is nonetheless obtained good formation of the paper web or sheet accompanied by good dewatering.

To achieve a uniform formation of the paper web and for undertaking for this purpose a simultaneous dewatering of the paper web at both sides thereof, there can be arranged in the first forming section and also in the second forming section at least two stationary forming elements located essentially opposite one another. These at least two oppositely situated or facing forming elements in each forming section do not have to be coextensive or overlap one another throughout the full length thereof. They also can form a partial forming section which thus impinges the twin forming wires at both sides or faces thereof. This partial forming section is advantageously shorter than the wrap length of the twin forming wires at the main forming roller located between the first and second forming sections.

To achieve a further improvement of the formation and thus the web or sheet formation, one of the oppositely situated forming elements can be constructed as a forming shoe having a curved or straight contact surface and the other forming element can be constructed as at least one forming pressure foil or foil ledge or equivalent structure.

The respectively upper situated stationary forming element can be particularly constructed as a forming shoe with suction or vacuum dewatering.

In the second forming section there can be arranged following the stationary forming element, which especially is a forming shoe, a separation element which, for example, can be constructed as a separation roller or as a separation suction device.

Additionally, in the second forming section there can be arranged forwardly or upstream of the stationary forming element, which especially is a forming shoe, and especially an upper situated forming shoe, a presuction device.

Moreover, there likewise can be arranged in the second forming section directly forwardly or upstream of the stationary forming element, constructed especially as an upper situated forming element and particularly as a forming shoe, a curved forming shoe. This curved forming shoe particularly bears against or contacts the lower situated transport or forming wire. The wire length of the first forming section contacted by the forming shoe is preferably shorter than the wrap length of the forming wires of the subsequently arranged forming roller.

The forming roller located intermediate the first and second forming sections can be an open forming roller, and specifically, either such a forming roller whose surface is opened by a grill or honeycomb structure forming or is constituted by a suction roller.

The active surface of the stationary forming element, especially the stationary forming element located in the second forming zone, can be disposed in the region between the upper apex point and the lower apex point of the forming roller located between the first forming section and the second forming section.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same elements, and wherein.

DETAILED DESCRIPTION OF THE PREFERRED EMBODIMENTS

Figure 1:
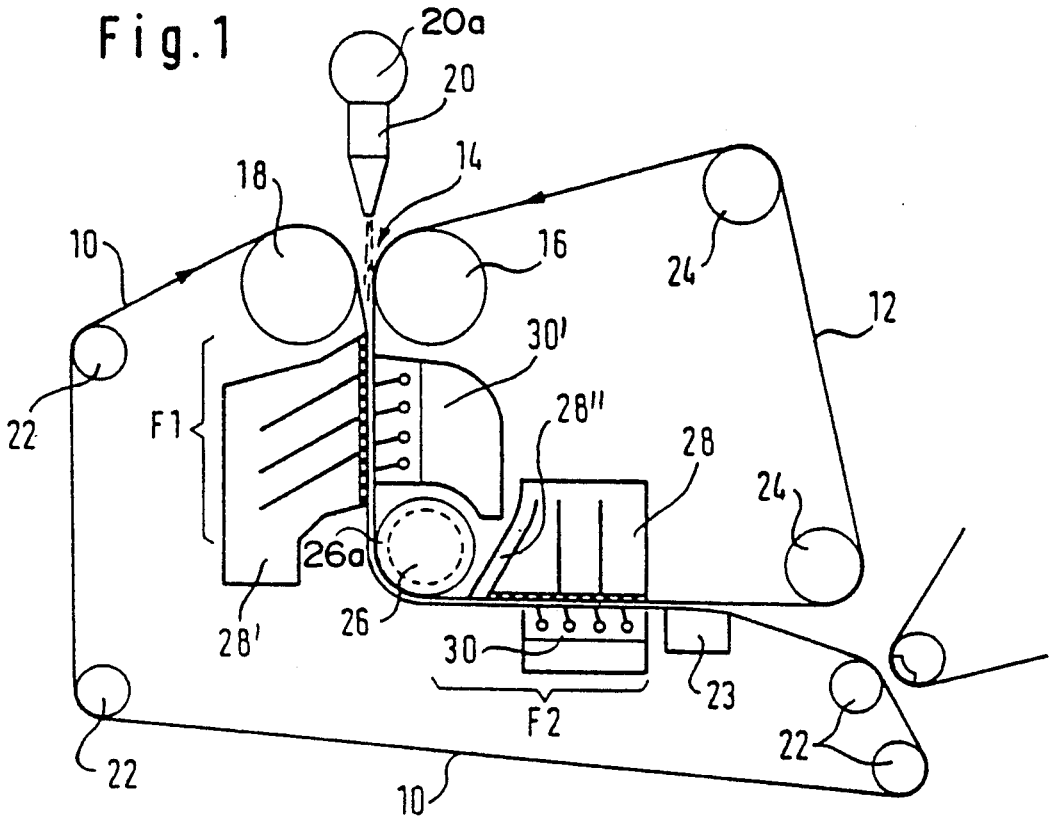
FIG. 1 is a schematic front view of a twin wire former according to a first embodiment of the present invention.

Describing now the drawings, it is to be understood that only enough of the construction of the different embodiments of twin wire formers of a papermaking machine according to the present invention has been depicted therein, in order to simplify the illustration, as needed for those skilled in the art to readily understand the underlying principles and concepts of the present invention.

Turning now to the drawings, it will be understood that the twin wire formers of the various herein disclosed exemplary embodiments depicted in FIGS. 1 to 7, comprise a first endless forming wire 10 defining a transport wire and a second endless forming wire 12 defining a counter wire. These co-running first and second forming wires 10 and 12 move in a predetermined direction of travel indicated by the depicted arrows and merge with or converge towards one another to form therebetween a fiber stock inlet gap or wedge opening 14. At that location the two forming wires 10 and 12 are guided over breast rollers or rolls 16 and 18, and in the arrangements of FIGS. 2 and 3 each of the breast rollers 16' is constructed as an open forming roller about which both of the forming wires 10 and 12 are brought or joined together throughout a predetermined wrap angle, and specifically, while enclosing or sandwiching therebetween the fiber stock or fiber stock suspension from which there is formed the paper web or sheet. It will be thus appreciated that this breast or forming roller 16' is located at the region of the fiber stock inlet gap or wedge opening 14.

A headbox nozzle 20 of a suitable headbox **20*a* is arranged upstream or forwardly of the fiber stock inlet gap or wedge opening 14 with respect to the predetermined direction of travel of the two co-running forming wires 10 and 12. In the arrangement of FIG. 1 the infeed of the fiber stock is accomplished by such headbox nozzle 20 of the headbox 20*a* in substantially downward vertical direction and is located above the fiber stock inlet gap or wedge opening 14. On the other hand, in the modified embodiment of FIG. 2, the infeed of the fiber stock is accomplished by the headbox nozzle 20 of the headbox 20*a* from beneath the fiber stock inlet gap 14 at an inclination to the horizontal from the left of such illustration upwardly towards the right of FIG. 2, and this also is the case for the embodiment of FIG. 3. However, in the further modified embodiment of FIG. 4, the infeed of the fiber stock is accomplished by the headbox nozzle 20 of the headbox 20*a* substantially vertically from the bottom towards the top from a location beneath the fiber stock inlet gap 14, and this is also basically the case for the embodiments of FIGS. 5 and 6 but here at a slight inclination with respect to the vertical. Finally, in the arrangement of FIG. 7** the fiber stock infeed also is performed from the bottom towards the top but at a somewhat more pronounced vertical inclination.

Additionally, it will be seen that the two co-running or co-travelling forming wires 10 and 12 are guided as endless revolving or looped forming wires over deflection rollers 22 and 24, respectively. As a matter of convenience in the drawing portrayal, the second forming wire 12 has only been partially depicted in the embodiments of FIGS. 2 to 6.

Figure 7:
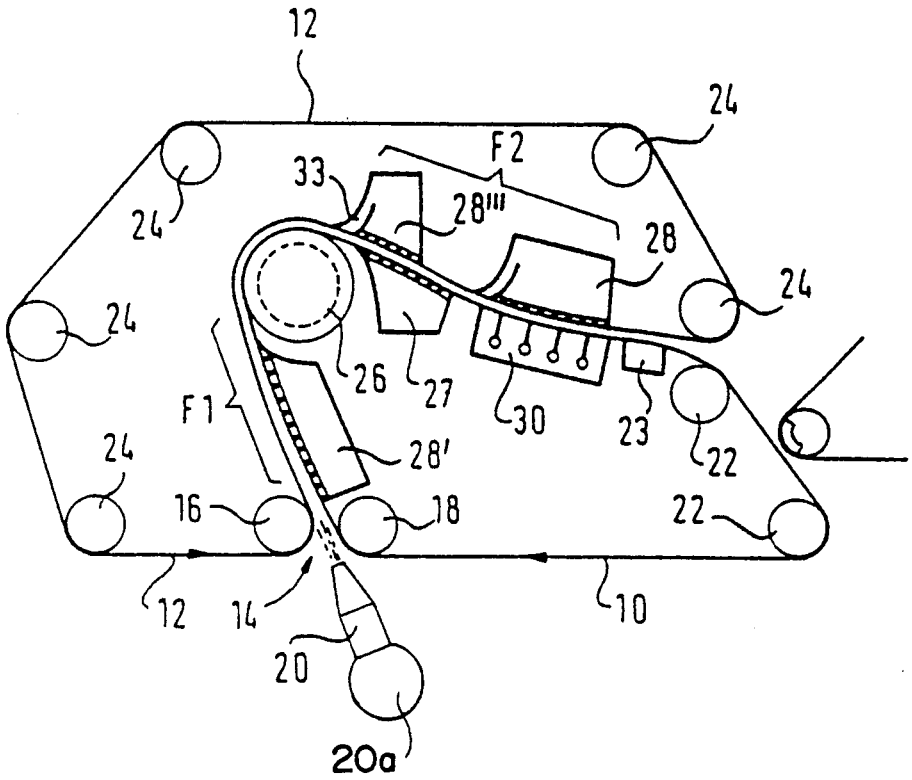
FIG. 7 is a schematic front view of a twin wire former according to a seventh embodiment of the present invention.

The entire web r sheet forming zone is sub-divided into two forming sections or paths, and specifically, a first forming section or path F1 and a second forming section or path F2, through which there are conjointly moved the two forming wires 10 and 12 with the fiber stock or fiber stock suspension sandwiched therebetween. Between the first forming section F1 and the second forming section F2 there is located a preferably open forming roller or roll 26 which also can be conveniently referred to as a main forming roller or roll. At the location of this forming roller 26 there is accomplished a deflection or turning of the twin wires or two forming wires 10 and 12. In each of the different embodiments of twin wire former respectively depicted in FIG. 1, FIG. 2, FIG. 3, FIG. 4, FIG. 5 and FIG. 6, the deflection angle amounts to about 90° and in the embodiment of FIG. 7 is less than 90°. This deflection or turning angle can be in the range of 30° to 120°. This would require a corresponding wrap angle $\alpha$of the main forming roller 26.

In the embodiments of each of FIGS. 1, 2, 3 and 4, there are located in the previously mentioned forming sections F1 and F2 to both sides of the two forming wires 10 and 12, that is, at the side of each such forming wire 10 and 12, a stationary forming element in the form of a so-called forming shoe 28' and 28 and the forming pressure foils or foil ledges 30' and 30, which are mounted upon suitable adjustable elements and bear or contact with pressure preferably at the twin wires 10 and 12 or at one of the forming wires 10 or 12, as the case may be, of such twin wires 10 and 12. As will be readily observed in the drawings of FIGS. 1 to 4, here there is preferably arranged in each case a forming shoe 28' or 28 opposite to a series of tandemly arranged forming pressure foils or foil ledges 30, for example, four to five such forming pressure foils. The correspondingly employed water removal or drainage systems are adapted to this arrangement, depending upon whether the water is to be removed opposite to or in the direction of the force of gravity. This confronting or facing configuration of forming shoes 28 and pressure foils or foil ledges 30 is also depicted in the second forming section F2 of the embodiments of FIGS. 5 and 7.

It is here indicated that in all of the different exemplary embodiments, apart from the embodiment depicted in FIG. 7, in each instance one of the forming sections extends substantially horizontally and the other of the forming sections extends substantially vertically. Thus, for these indicated embodiments, the forming section F1 is disposed substantially vertically and the other forming section F2 is disposed substantially horizontally, but, in principle, such arrangement can be reversed even though the depicted exemplary embodiments afford particular advantages.

Figure 2:
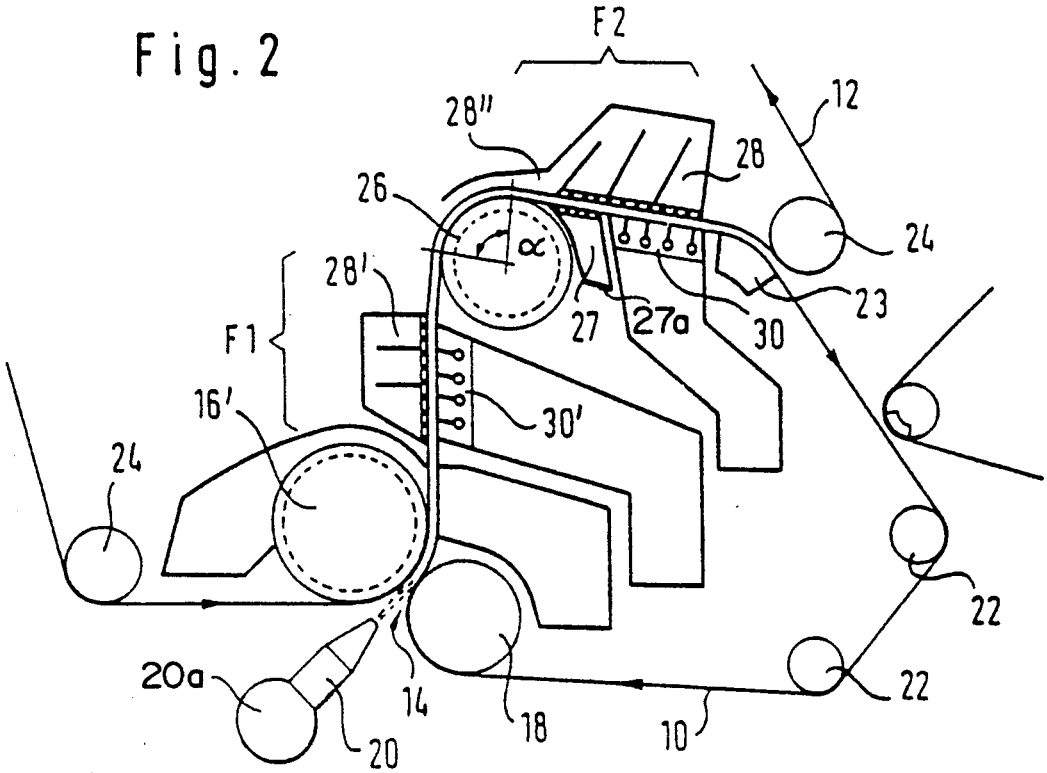
FIG. 2 is a schematic front view of a twin wire former according to a second embodiment of the present invention.
Figure 3:
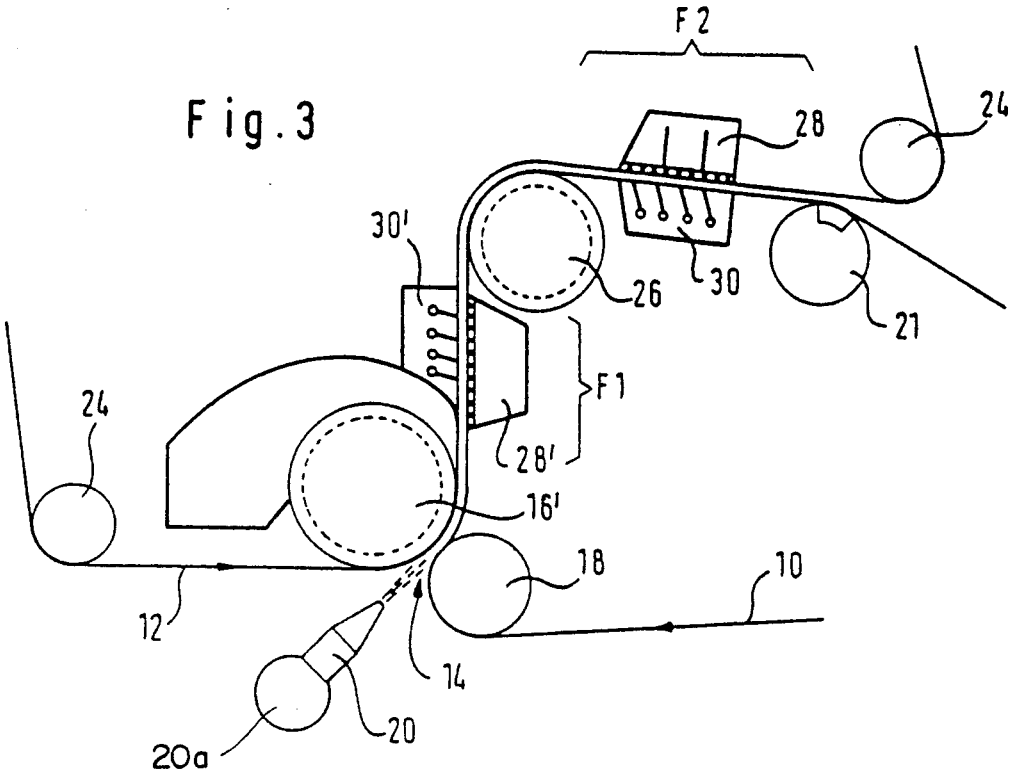
FIG. 3 is a schematic front view of a twin wire former according to a third embodiment of the present invention.

In the embodiment of FIG. 2, a forming shoe 27 is arranged forwardly or upstream of the forming pressure foils or foil ledges 30, with respect to the predetermined direction of travel of the two forming wires 10 and 12, at the second forming section F2 at the region of the first forming wire 10 defining the transport wire. This forming shoe 27 need not absolutely be provided with suction water removal or drainage, schematically indicated by the suction water removal means 27*a*. In the respective embodiments of FIGS. 1 and 2, a so-called top suction or pre-suction device 28'' is arranged forwardly or upstream of the forming shoe 28, with respect to the predetermined direction of travel of the two forming wires 10 and 12, this forming shoe 28 being arranged in the second forming section F2 and contacts or bears against the forming wire 12 defining the counter wire.

In each of the embodiments of FIGS. 1, 2, 4, 5 and 7, a separation suction device or box 23 is arranged behind or downstream of the second forming section F2, preferably at the transport or forming wire 10, as viewed with respect to the predetermined direction of travel of the two forming wires 10 and 12. In each of the embodiments of FIGS. 3 and 6 such separation suction device is constructed as a separation roller or roll 21.

Figure 4:
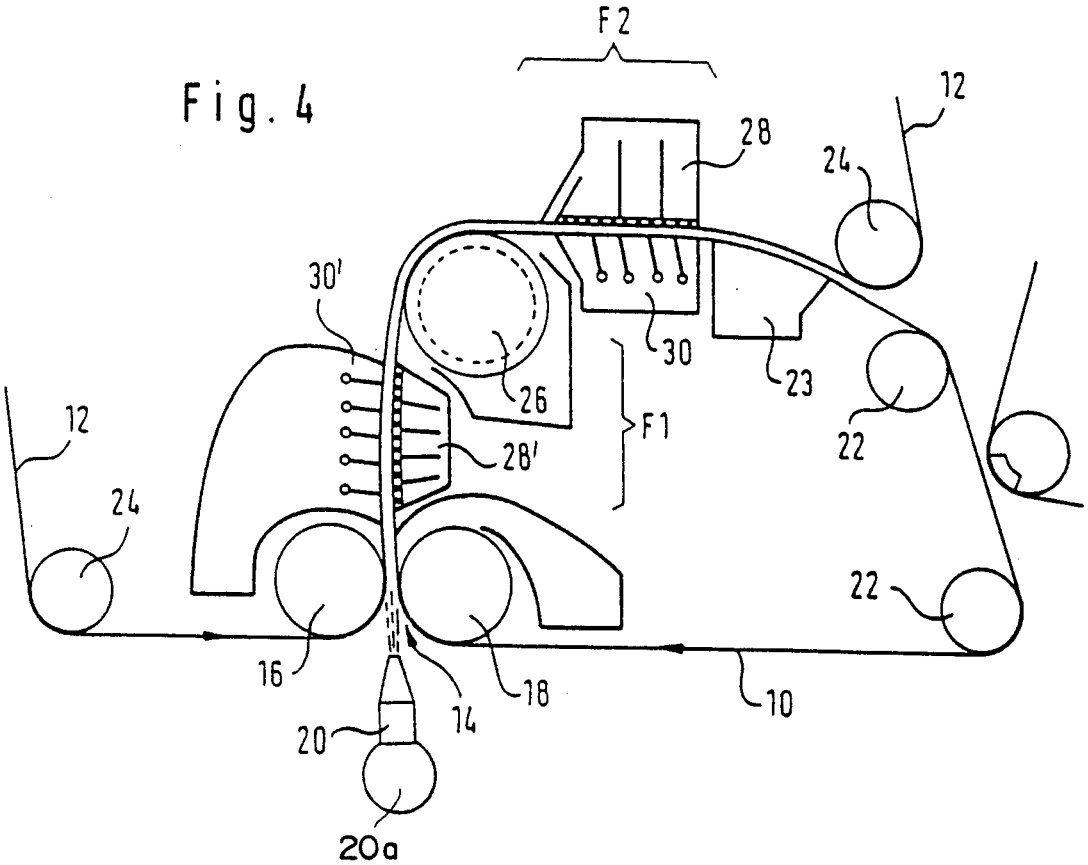
FIG. 4 is a schematic front view of a twin wire former according to a fourth embodiment of the present invention.

The forming or dewatering shoes, like the shoes 28 and 28', can be each provided with a curved surface (see, for example, FIGS. 4 and 6), but also with a straight or linear surface (see, for example, FIGS. 1 to 4). They can be operated with or without vacuum. In the arrangement of FIG. 4 the curved forming shoe 28', for instance operated with vacuum, has situated opposite thereto the pressure foil means containing, for instance, five pressure foils or foil ledges 30'. If directly opposite the forming shoe there is not provided a wire support by means of a forming element, then the forming shoe is preferably provided with a curved surface, as such has been particularly depicted in FIG. 6 for the forming shoes 28 and 28' thereof. As clearly shown in FIGS. 5, 6 and 7 a further forming shoe 28''' provided with a pre-suction device 33 can be arranged forwardly or upstream of the forming shoe 28, with respect to the predetermined direction of travel of the two forming wires 10 and 12, at the side of the counter wire or forming wire 12.

The main forming roller or roll 26 can be constructed as an open roller or roll, for example, as an open roller or roll possessing a grill or honeycomb structure, generally indicated by reference numeral 26*a* in FIG. 1, or as a suction roller.

It is here further pointed out that both of the endless revolving forming wires 10 and 22 are at least partially conjointly trained about the circumference of the forming roller 26 throughout a predetermined wrap length. The second forming section F2 may have a length amounting to at least 80% of this predetermined wrap length or which is equal to or especially greater than such predetermined wrap length.

Figure 5:
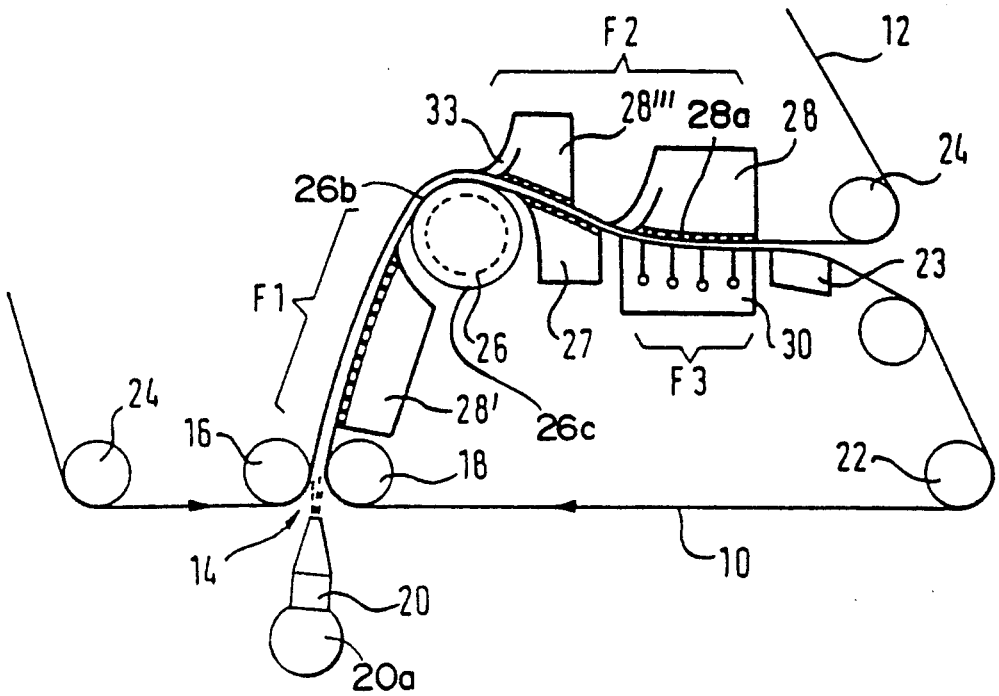
FIG. 5 is a schematic front view of a twin wire former according to a fifth embodiment of the present invention.
Figure 6:
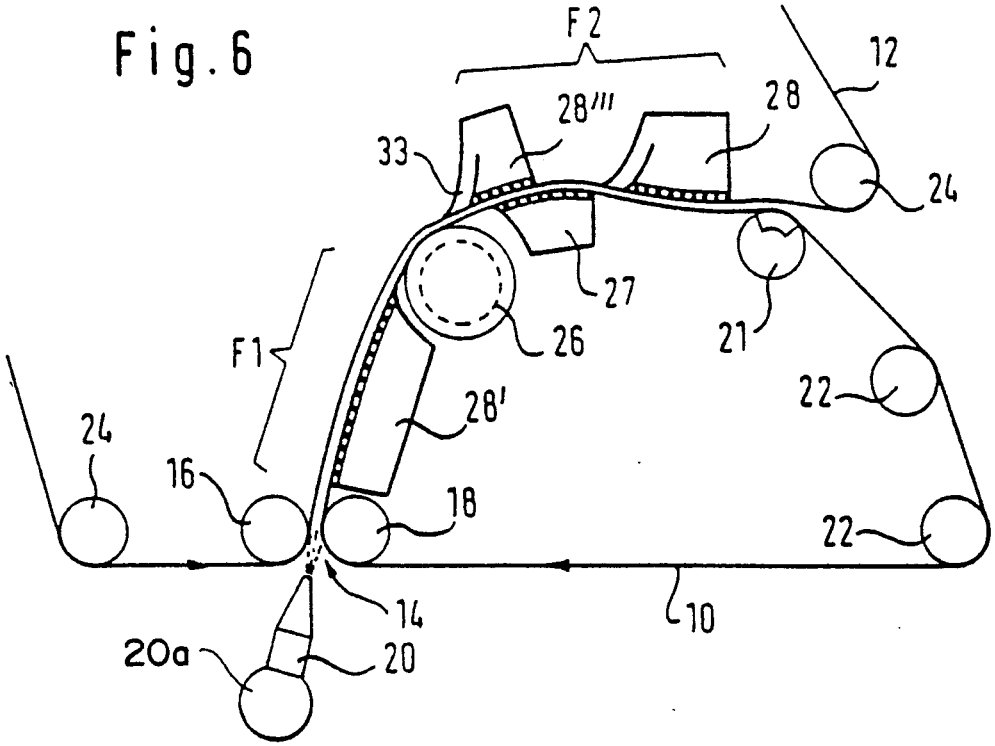
FIG. 6 is a schematic front view of a twin wire former according to a sixth embodiment of the present invention.

Furthermore, as depicted, for instance, in the arrangement of FIG. 5, the forming element 28 has an active surface 28*a* which is located at a region between an upper apex point 26*b* and a lower apex point 26*c* of the forming roller 26 disposed between the first forming section F1 and the second forming section F2. In this arrangement there is also defined between the forming elements 28 and 30 a partial forming section F3 which contacts both sides of the twin forming wires 10 and 12. This partial forming section F3 may have a length which is shorter that the predetermined wrap length of the forming wires 10 and 12 about the circumference or periphery of the forming roller 26.

While there are shown and described present preferred embodiments of the invention, it is distinctly to be understood the invention is not limited thereto, but may be otherwise variously embodied and practiced within the scope of the following claims.

What is claimed is:

1. A twin wire former for the manufacture of paper, comprising:

two endless revolving forming wires which converge towards one another to conjointly form therebetween a fiber stock inlet gap and moving in a predetermined direction of travel;

means for conjointly guiding the two endless revolving forming wires along a web forming zone;

one of the two endless forming wires defining a transport wire;

the other one of the two endless forming wires defining a counter wire;

at least one forming roller having a circumference;

both of the endless revolving forming wires being at least partially conjointly trained about the circumference of the at least one forming roller;

at least one stationary forming element arranged forwardly of the forming roller in a first forming section of the web forming zone at at least one side of the two forming wires, as viewed in the predetermined direction of travel of the forming wires;

a second forming section of the web forming zone arranged after the forming roller in the predetermined direction of travel of the forming wires;

at least one further stationary forming element arranged at least at one side of the second forming section;

said further stationary forming element bearing against at least one of the forming wires;

at least one additional forming element situated oppositely of said further stationary forming element with respect to the forming wires in said second forming section;

a vacuum water removal device for operation in conjunction with at least one of said at least one further stationary forming element and said at least one additional forming element in said second forming section of the web forming zone;

at least one additional stationary forming element arranged in the first forming section;

said at least one additional stationary forming element being situated opposite said at least one stationary forming element, to thereby provide at least two oppositely situated stationary forming elements in the first forming section;

one of the at least two oppositely situated stationary forming elements in the first forming section comprises a forming shoe having a contact surface selected from the group consisting of curved and substantially straight;

the other one of the at least two oppositely situated stationary forming elements in the first forming section comprises at least one forming pressure foil means mounted upon adjustable elements for exerting pressure against said forming wires;

one of the at least one further stationary forming element in the second forming section comprises a forming shoe having a contact surface selected from the group consisting of curved or straight;

one of the at least one additional oppositely situated forming element in the second forming section comprises at least one forming pressure foil means mounted upon adjustable elements for exerting pressure against said forming wires;

said second forming section of the web forming zone has a horizontal component with respect to the predetermined direction of travel of the forming wires;

said at least one additional forming element comprises at least one upper forming element positioned above the forming wires in said second forming section; and said vacuum water removal device is situated for operation with said at least one upper forming element.

2. The twin wire former according to claim 1, wherein:

the first forming section and the second forming section are arranged with respect to one another so as to enclose therebetween an angle in a range of about 30° to 120°.

3. The twin wire former according to claim 2, wherein:

the first forming section and the second forming section are arranged with respect to one another so as to enclose therebetween an angle essentially amounting to 90°.

4. The twin wire former according to claim 1, wherein:

the fiber stock inlet gap is arranged above the first forming section.

5. The twin wire former according to claim 1, wherein:

the fiber stock inlet gap is arranged beneath the first forming section.

6. The twin wire former according to claim 1, wherein:

the at least one stationary forming element comprises a forming shoe.

7. The twin wire formed according to claim 1, further including:

an additional forming roller arranged at the region of the fiber stock inlet gap.

8. The twin wire former according to claim 1, wherein:

both of the endless revolving forming wires being at least partially conjointly trained about the circumference of the at least one forming roller throughout a predetermined wrap length; and the second forming section having a length amounting to at least 80% of said predetermined wrap length of both of the endless revolving forming wires about the circumference of the at least one forming roller.

9. The twin wire former according to claim 1, wherein:

both of the endless revolving forming wires being at least partially conjointly trained about the circumference of the at least one forming roller throughout a predetermined wrap length; and the second forming section having a length which is greater than at least 80% of said predetermined wrap length of both of the endless revolving forming wires about the circumference of the at least one forming roller.

10. The twin wire former according to claim 1, wherein:

both of the endless revolving forming wires being at least partially conjointly trained about the circumference of the at least one forming roller throughout a predetermined wrap length; and the second forming section having a length which is substantially equal to said predetermined wrap length of both of the endless revolving forming wires about the circumference of the at least one forming roller.

11. The twin wire former according to claim 1, wherein:

the at least one additional forming element comprises at least four successively arranged forming pressure foils, mounted upon adjustable elements for exerting pressure against said forming wires.

12. The twin wire former according to claim 1, wherein:

the at least one stationary forming element comprises five successively arranged forming pressure foils, mounted upon adjustable elements for exerting pressure against said forming wires.

13. The twin wire former according to claim 1, further including:

said contact surface of each of said forming shoes is curved; and a vacuum water removal device for operation with each of said respective curved forming shoes.

14. The twin wire former according to claim 1, wherein:

said contact surface of said forming shoe of said one of the at least two oppositely situated stationary forming elements in the first forming section is curved.

15. The twin wire former according to claim 1, wherein:

said contact surface of said forming shoe of said one of the at least two oppositely situated stationary forming elements in the first forming section is substantially straight.

16. The twin wire former according to claim 1, wherein:

said contact surface of said forming shoe of said one of the at least one further stationary forming element in the second forming section is curved.

17. The twin wire former according to claim 1, wherein:

said contact surface of said forming shoe of said one of the at least one further stationary forming element in the second forming section is substantially straight.

18. The twin wire former according to claim 1, further including:

a separation element arranged downstream of the second forming section after the further stationary forming element with respect to the predetermined direction of travel of the forming wires.

19. The twin wire former according to claim 18, wherein:

the separation element comprises a separation roller.

20. The twin wire former according to claim 18, wherein:

the separation element comprises a separation suction device.

21. The twin wire former according to claim 1, further including:

a pre-suction device arranged in the second forming section forwardly of the further stationary forming element with respect to the predetermined direction of travel of the forming wires.

22. The twin wire former according to claim 1, wherein:

the at least one forming roller having an upper apex point and a lower apex point;

the further stationary forming element having an active surface; and the active surface of the further stationary forming element being located at a region between the upper apex point and the lower apex point of the at least one forming roller.

23. The twin wire former according to claim 1, further including:

a partial forming section;

the at least one forming roller defining a main forming roller;

both of the endless revolving forming wires being at least partially conjointly trained about the circumference of the main forming roller throughout a predetermined wrap length; and the partial forming section having a length which is shorter than the predetermined wrap length of the main forming roller.

24. The twin wire former according to claim 1, wherein:

said contact surface of said forming shoe in the first forming section contacts at least one of the forming wires along a predetermined wire length;

both of the endless revolving forming wires being at least partially conjointly trained about the circumference of the at least one forming roller throughout a predetermined wrap length; and said predetermined wire length contacted by the forming shoe being shorter than the predetermined wrap length of the at least one forming roller.

25. The twin wire former according to claim 1, wherein:

the at least one forming roller comprises an open roller.

26. The twin wire former according to claim 25, wherein:

the open roller comprises a roller possessing a honeycomb structure.

27. The twin wire former according to claim 25, wherein:

the open roller comprises a suction roller.

* * * * *